United States Patent [19]

Blair

[11] Patent Number: 4,785,556

[45] Date of Patent: Nov. 22, 1988

[54] OVER SHOE

[76] Inventor: Kathy L. Blair, 6618 S. Jackson Ct, Littleton, Colo. 80121

[21] Appl. No.: 114,033

[22] Filed: Oct. 29, 1987

[51] Int. Cl.[4] ..... A43B 3/16; A43B 3/18

[52] U.S. Cl. ..... 36/7.3; 36/7.1 R

[58] Field of Search ..... 36/7.1 R, 7.3, 38 B, 36/72 R, 72 B, 1.5, 7.1 A, 7.5, 73, 71.5, 70 R

[56] References Cited

U.S. PATENT DOCUMENTS

| | | | |
|---|---|---|---|
| Re. 13,928 | 6/1915 | Ferguson | 36/7.3 |
| D. 20,384 | 5/1940 | Mancik et al. | D2/271 |
| D. 195,618 | 7/1963 | Slade | D7/4 |
| D. 209,036 | 10/1967 | Zimmon | D2/271 |
| 1,339,994 | 5/1920 | Westling | 36/7.3 |
| 1,467,950 | 9/1923 | Rauscher | 36/7.3 |
| 1,537,778 | 5/1925 | Nyhagen | 36/7.3 |
| 1,794,035 | 2/1931 | Schönfeld | 36/7.1 |
| 2,657,477 | 11/1953 | Winslow | 36/7.3 |
| 2,986,823 | 6/1961 | Kos | 36/7.1 R |
| 3,026,635 | 3/1962 | Slade | 36/7.3 |
| 3,045,365 | 7/1962 | Bingham, Jr. | 36/7.1 A |
| 3,077,679 | 2/1963 | Hanko et al. | 36/7.1 A |
| 3,141,297 | 7/1964 | Mackay | 36/7.1 R |
| 3,221,421 | 12/1965 | Liebmann et al. | 36/7.1 |
| 3,724,107 | 4/1973 | Makinen et al. | 36/7.3 |
| 4,489,509 | 12/1984 | Libit | 36/7.1 R |
| 4,516,336 | 5/1985 | Nissenbaum | 36/7.3 |

FOREIGN PATENT DOCUMENTS

| | | | |
|---|---|---|---|
| 1263055 | 4/1961 | France | 36/72 B |
| 357961 | 9/1931 | United Kingdom | 36/72 R |

*Primary Examiner*—Steven N. Meyers
*Attorney, Agent, or Firm*—Klaas & Law

[57] ABSTRACT

An over shoe for protecting a variety of inner shoes having similarly shaped body portions but heel portions of differing lengths wherein the length of the heel portion of the over shoe may be readily extended to accommodate heel portions of differing lengths of inner shoes.

11 Claims, 2 Drawing Sheets

OVER SHOE

FIELD OF THE INVENTION

This invention is directed generally to over shoes of the type used to protect an inner shoe from deleterious elements and more particularly to an over shoe that is provided with heel length extending means so that the over shoe may be used with a variety of inner shoes having similar body portions but heel portions of differing lengths.

BACKGROUND OF THE INVENTION

It is a common practice for many women to have a plurality of shoes having a similarly constructed body portion but having different heel portions which differ mainly in the length of the heel portion. The reason for having such a number of shoes is that certain shoes are to be worn with certain other articles of clothing so that there is no clash of colors to spoil the appearance of the wearer. A problem that occurs under such circumstances relates to over shoes that are worn to protect an inner shoe from inclement weather conditions. As a general rule, it is not practical from an economic consideration to have an over shoe for each inner shoe. Also, it is not practical from an aesthetic consideration to use the same wearing apparel in inclement weather so that one pair of over shoes is sufficient. As far as applicant is aware, no solution has been provided for the foregoing problem.

BRIEF DESCRIPTION OF THE INVENTION

This invention provides an over shoe for use in protecting an inner shoe in inclement weather wherein the over shoe means has heel portions provided with length extending means so that the over shoe means may be used with a plurality of inner shoes having similarly shaped body portions but having heel portions with differing lengths.

In the preferred embodiment of the invention, there is provided an over shoe means having a main body portion that is similar to the main body portion of a plurality of inner shoes. The over shoe means has a heel portion which is adapted to receive the heel portion of the plurality of inner shoes even where the heel portions thereof are of differing lengths. The heel portion of the over shoe means is provided with length extending means so that when the inner shoe is placed completely in the over shoe means, the length of the heel portion of the over shoe means will coincide with the length of the heel portion of the inner shoe. The heel portion of the over shoe means extends downwardly from the main body portion and is integral therewith. The heel portion has a base tread portion having an outer surface and an inner surface and comprises a relatively rigid material which will retain its original shape when a force is applied thereto. A hollow central body portion of the heel portion is integral with the main body portion and the base tread portion and has a longitudinal axis extending from the main body portion to the base tread portion. The length extending means comprises a plurality of spaced apart circumferentially extending folds in the central body portion, similar to accordion pleats. The central body portion is formed to retain its original shape but will yield to a force applied thereto and return to its original shape when the force has been removed. Therefore, when the wearer places the over shoe means over an inner shoe with the heel portion of the inner shoe in the heel portion of the over shoe and applies a force to move the heel portion of the inner shoe downwardly, the base tread portion will be displaced a distance only to accommodate the length of the heel portion of the inner shoe. The tendency for the heel portion of the over shoe to return to its original shape will hold the base tread portion against the heel portion of the inner shoe during movements of the wearer. The invention may be utilized with a wide variety of styles of inner shoes provided that the inner shoes have generally similarly shaped main body portions.

BRIEF DESCRIPTION OF THE DRAWING

An illustrative and presently preferred embodiment of the invention is shown in the accompanying drawing in which.

DETAILED DESCRIPTION OF THE INVENTION

Figure 1:
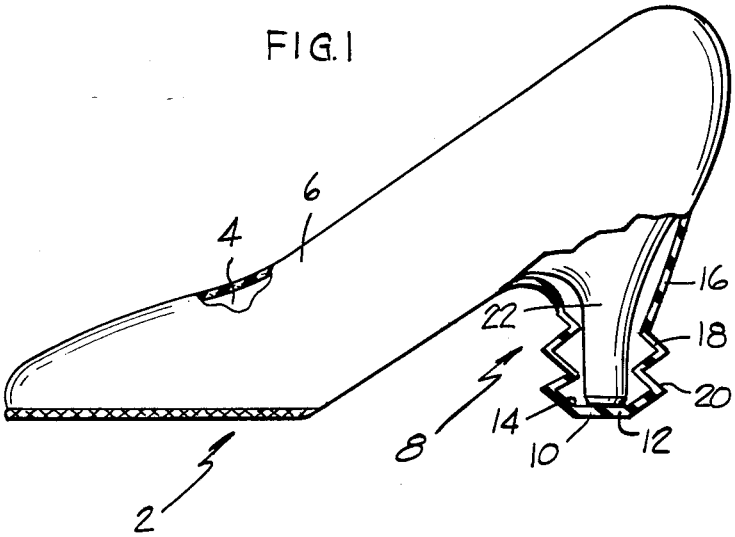
FIG. 1 is a side elevational view with parts in section of the preferred embodiment of the invention.
Figure 2:
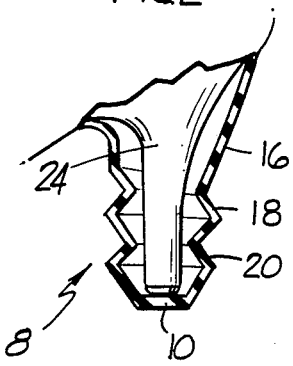
FIGS. 2 and 3 are side elevational views with parts in section showing different lengths of heels.
Figure 3:
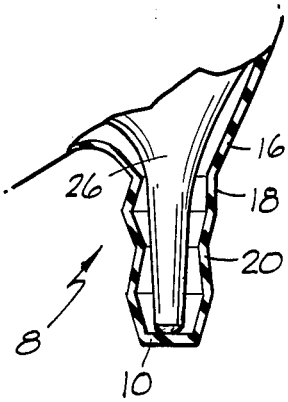

The preferred embodiment of the invention is illustrated in FIGS. 1–3 and comprises an over shoe means 2 for covering an inner shoe 4. The over shoe means 2 has a main body portion 6 which has substantially the same shape as the main body portion (not completely shown) of the inner shoe. The heel portion 8 of the over shoe means 2 is integral with the main body portion 6 and extends downwardly therefrom. The heel portion 8 has a base tread portion 10 having an outer surface 12 and an inner surface 14. The base tread portion 10 is formed from a relatively rigid material which will retain its shape when a force is applied thereto. The heel portion 8 has hollow central body portion 16 as illustrated in cross-section in FIG. 1 which is integral with the main body portion 6 and the base tread portion 10. The central body portion 16 has a plurality of spaced apart, circumferentially extending folds 18 and 20 formed therein. Only two folds 18 and 20 are illustrated in FIGS. 1–3 but it is understood that as many folds as desired may be used. The folds 18 and 20 provide length extending means for the heel portion 8 so that different lengths of heels (as described below) may be accommodated. The central body portion 16 is formed from a material that will retain its original shape but will yield to a force applied thereto and return to its original shape when the force is removed. Also, the over shoe means, including the heel portion, is formed from a material capable of protecting the inner shoe from deleterious materials, such as those accompanying inclement weather conditions. The folds 18 and 20 are similarly shaped as illustrated in cross-section in FIG. 1.

The operation of the invention is illustrated in FIGS. 1–3 wherein the spike heel 22 of FIG. 1 of the inner shoe 4 has moved the base tread portion 10 only slightly downwardly from the main body portion 6. The spike heel 24 of the inner shoe 4 in FIG. 2 has a length greater than the length of the spike heel 22 of FIG. 1 so that the base tread portion 10 has been moved downwardly from the main body portion 6 for a greater distance and the folds have been opened a greater amount. The spike heel 26 of the inner shoe 4 in FIG. 3 has a length greater than the length of the spike heel 24 of FIG. 2 so that the base tread portion 10 has been moved downwardly from the main body portion 6 an even greater distance and the folds 18 and 20 are almost fully opened.

Figure 4:
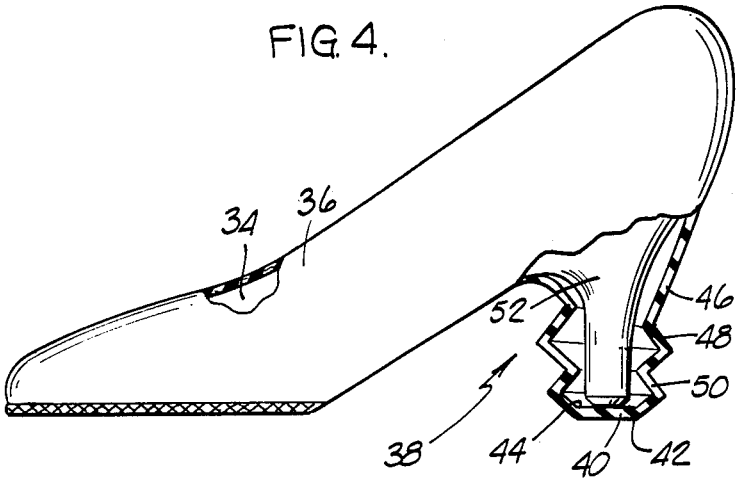
FIG. 4 is a side elevational view with parts in section of another embodiment of the invention.
Figure 5:
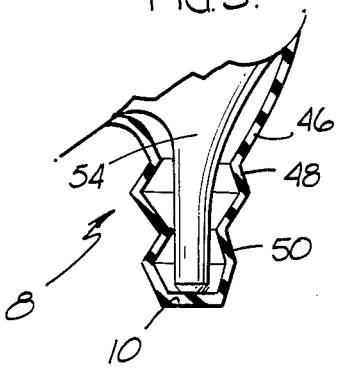
FIGS. 5 and 6 are side elevational views with parts in section showing different lengths of heels.
Figure 6:
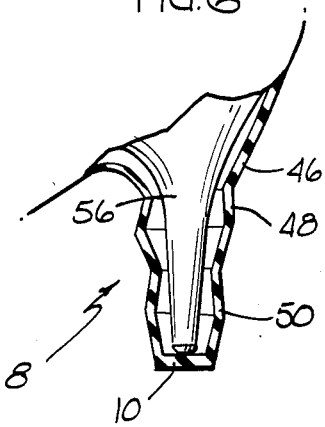

Another embodiment of the invention is illustrated in FIGS. 4–6 and comprises an over shoe means 32 for covering an inner shoe 34. The over shoe means 32 has a main body portion 36 which has the same shape as the main body portion (not completely shown) of the inner shoe. The heel portion 38 of the over shoe means 32 is integral with the main body portion 36 and extends downwardly therefrom. The heel portion 38 has a base tread portion 40 having an outer surface 42 and an inner surface 44. The base tread portion 40 is formed from a relatively rigid material which will retain its shape when a force is applied thereto. The heel portion 38 has hollow central body portion 46 as illustrated in cross-section in FIG. 4 which is integral with the main body portion 36 and the base tread portion 40. The central body portion 46 has a plurality of spaced apart, circumferentially extending folds 48 and 50 formed therein. Only two folds 48 and 50 are illustrated in FIGS. 4–6 but it is understood that as many folds as desired may be used. The folds 48 and 50 provide length extending means for the heel portion 38 so that different lengths of heels (as described below) may be accommodated. The central body portion 46 is formed from a material that will retain its original shape but will yield to a force applied thereto and return to its original shape when the force is removed. Also, the over shoe means, including the heel portion, is formed from a material capable of protecting the inner shoe from deleterious materials, such as those accompanying inclement weather conditions. The fold 48 has a cross-sectional area greater than the cross-sectional area of the fold 50 as illustrated in cross-section in FIG. 7.

The operation of the invention is illustrated in FIGS. 4–6 wherein the spike heel 52 of FIG. 4 of the inner shoe 34 has moved the base tread portion 40 only slightly downwardly from the main body portion 36. The spike heel 54 of the inner shoe 34 in FIG. 5 has a length greater than the length of the spike heel 52 of FIG. 4 so that the base tread portion 40 has been moved downwardly from the main body portion 36 for a greater distance and the folds have been opened a greater amount. The spike heel 56 of the inner shoe 34 in FIG. 6 has a length greater than the length of the spike heel 54 of FIG. 5 so that the base tread portion 40 has been moved downwardly from the main body portion 36 an even greater distance and the folds 48 and 50 are almost fully opened.

Figure 7:
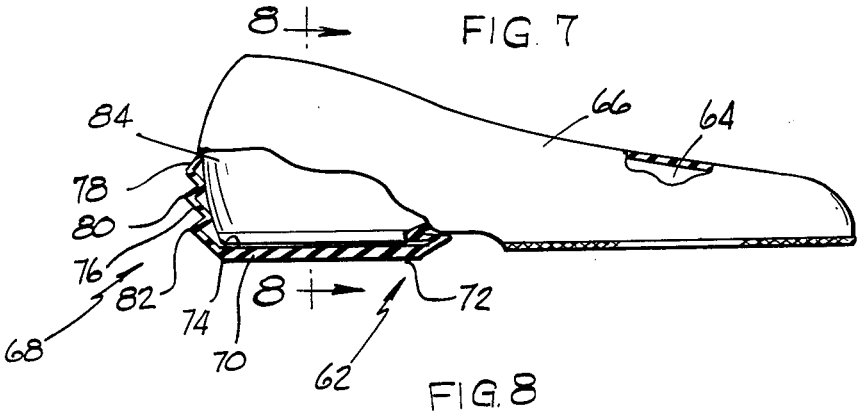
FIG. 7 is a side elevational view with parts in section of another shape of the invention.
Figure 8:
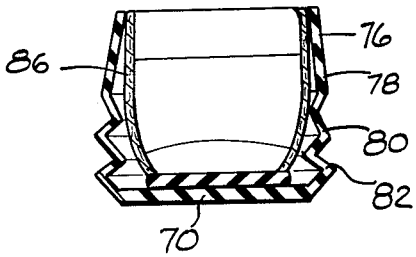
FIG. 8 is a cross-sectional view taken on the line 8—8 of FIG. 7.
Figure 9:
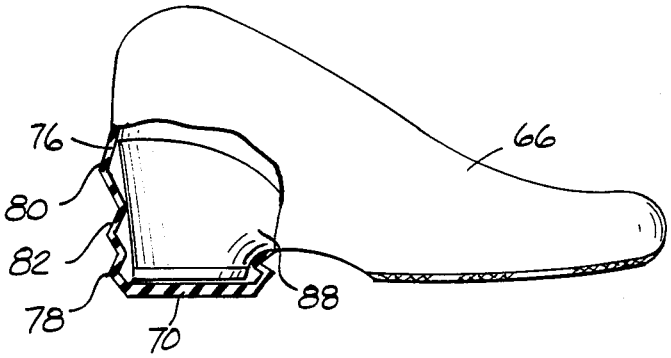
FIG. 9 is a side elevational view with parts in section showing a different length of heel.

Another shape of the invention is illustrated in FIGS. 7–9 and comprises an over shoe means 62 for covering an inner shoe 64. The over shoe means 62 has a main body portion 66 which has the same shape as the main body portion (not completely shown) of the inner shoe. The heel portion 68 of the over shoe means 62 is integral with the main body portion 66 and extends downwardly therefrom. The heel portion 68 has a base tread portion 70 having an outer surface 72 and an inner surface 74. The base tread portion 70 is formed from a relatively rigid material which will retain its shape when a force is applied thereto. The heel portion 68 has hollow central body portion 76 as illustrated in cross-section in FIG. 7 which is integral with the main body portion 66 and the base tread portion 70. The central body portion 76 has a plurality of spaced apart folds 78, 80 and 82 formed therein. The folds 78, 80 and 82 provide length extending means for the heel portion 68 so that different lengths of heels (as described below) may be accommodated. Because of the shape of the heels 84, 86 and 88, all of the plurality of folds 78, 80 and 82 do not extend completely circumferentially around the heel portions 68. However, they do extend in a circumferential direction for a distance sufficient to provide the length extending function therefor. The central body portion 76 is formed from a material that will retain its original shape but will yield to a force applied thereto and return to its original shape when the force is removed. Also, the over shoe means, including the heel portion, is formed from a material capable of protecting the inner shoe from deleterious materials, such as those accompanying inclement weather conditions.

The operation of the invention is illustrated in FIGS. 7–9 wherein the wedge-type heel 84 of the inner shoe 64 in FIG. 7 has moved the base tread portion 70 only slightly downwardly from the main body portion 66. The wedge-type heel 86 of the inner shoe 64 in FIG. 8 has a length greater than the length of the wedge-type heel 84 of FIG. 7 so that the base tread portion 70 has been moved downwardly from the main body portion 66 for a greater distance and the folds 78, 80 and 82 have been opened a greater amount. The wedge-type heel 88 of the inner shoe 64 in FIG. 9 has a length greater than the length of the wedge-type heel 86 in FIG. 8 so that the base tread portion 70 has been moved downwardly from the main body portion 66 for a greater distance and the folds 78, 80 and 82 have been opened a greater amount.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. An over shoe for protecting an inner shoe having a heel portion from the elements for use with similarly shaped shoes but having differing heel lengths comprising:

an over shoe having a main body portion for receiving the main body portion of an inner shoe;

said over shoe having a heel portion for receiving the heel portion of said inner shoe;

said over shoe formed from a material capable of protecting the inner shoe from deleterious materials;

said heel portion of said over shoe extends downwardly from said main body portion of said over shoe and is integral therewith;

said heel portion of said over shoe having a base tread portion having an outer surface and an inner surface;

said heel portion of said over shoe having a hollow central body portion integral with said main body portion of said over shoe and said base tread portion and having a longitudinal axis extending from said main body portion of said over shoe to said base tread portion;

said heel portion of said over shoe having length extending means so that when said inner shoe has been placed completely within said over shoe, the length of said heel portion of said over shoe will coincide with the length of said heel portion of said inner shoe; and wherein said length extending means comprises:

a plurality of spaced apart circumferentially extending folds in said central body portion; and said heel portion of said over shoe comprises a material that will retain its original shape but will yield to a force applied thereto and return to its original shape when said force has been removed.

2. An over shoe as in claim 1 wherein:

said over shoe is for a spike-type heel inner shoe.

3. An over shoe as in claim I wherein:

said over shoe is for a wedge-type heel inner shoe.

4. An over shoe as in claim 1 wherein:

said base tread portion comprises a relatively rigid material so as to retain its original shape when a force is applied thereto.

5. As over shoe as in claim 4 and further comprising:

said inner surface having a transverse area that is greater than the transverse area of said heel portion of an inner shoe to be accommodated by said heel portion of said over shoe.

6. An over shoe as in claim 5 and further comprising:

said central body portion when in said fully extended position has a cross-sectional area that is greater than the similarly located cross-sectional area of said heel portion of an inner shoe to be accommodated by said heel portion of said over shoe.

7. An over shoe as in claim 6 wherein:

said folds are of the same shape.

8. An over shoe as in claim 1 and further comprising:

said length extending means permitting movement of said heel portion of said over shoe means from an original position to a fully extended position wherein all of said folds have been straightened.

9. An over shoe as in claim 8 and further comprising:

said inner surface having a transverse area that is greater than the transverse area of said heel portion of an inner shoe to be accommodated by said heel portion of said over shoe.

10. An over shoe as in claim 9 and further comprising:

said central body portion when in said fully extended position has a cross-sectional area that is greater than the similarly located cross-sectional area of said heel portion of an inner shoe to be accommodated by said heel portion of said over shoe.

11. An over shoe as in claim 8 wherein:

said folds are of the same shape.

* * * * *